US005222674A

United States Patent [19]

Hans et al.

[11] Patent Number: 5,222,674

[45] Date of Patent: Jun. 29, 1993

[54] ELECTROMAGNETICALLY ACTUABLE FUEL INJECTION VALVE

[75] Inventors: Waldemar Hans; Christian Preussner, both of Bamberg, Fed. Rep. of Germany

[73] Assignee: Robert Bosch GmbH, Stuttgart, Fed. Rep. of Germany

[21] Appl. No.: 778,110

[22] PCT Filed: Apr. 24, 1991

[86] PCT No.: PCT/DE91/00331

§ 371 Date: Dec. 13, 1991

§ 102(e) Date: Dec. 13, 1991

[87] PCT Pub. No.: WO91/19089

PCT Pub. Date: Dec. 12, 1991

[30] Foreign Application Priority Data

Jun. 8, 1990 [DE] Fed. Rep. of Germany ..... 4018317

[51] Int. Cl.[5] ..... F02M 51/06; F02M 61/12

[52] U.S. Cl. ..... 239/585.5; 239/585.1

[58] Field of Search ..... 239/585.1, 585.4, 585.5; 251/129.21

[56] References Cited

U.S. PATENT DOCUMENTS 4,637,554 1/1987 Takeda ..... 239/900 X

FOREIGN PATENT DOCUMENTS 2905099 8/1980 Fed. Rep. of Germany .

2180887 4/1987 United Kingdom .

*Primary Examiner*—Andres Kashnikow

*Assistant Examiner*—William Grant

*Attorney, Agent, or Firm*—Edwin E. Greigg; Ronald E. Greigg

[57] ABSTRACT

A stop plate for assembly between a stop shoulder of a valve needle and an inner shoulder of a valve casing in known fuel injection valves. The stop plate limits the stroke of the valve needle and, between its through opening and its circumference, has an assembly slot. During the flanging of the valve casing and the high axial forces connected with this assembly a high edge pressure at the assembly slot and nonuniform deformations of the valve casing may occur. The stop plate includes at least two recesses which are formed in an upper stop face of the stop plate, the said stop face resting against the inner shoulder of the valve casing, these recesses lying symmetrically to a center line of the assembly slot and in a half of the stop plate in which the assembly slot is not formed. The recesses lead to a uniform and reduced impressing of the stop plate into the valve casing. This configuration of the fuel injection valve is particularly suitable for fuel injection systems of spark-ignition internal combustion engines.

16 Claims, 2 Drawing Sheets

ELECTROMAGNETICALLY ACTUABLE FUEL INJECTION VALVE

PRIOR ART

Figure 1:
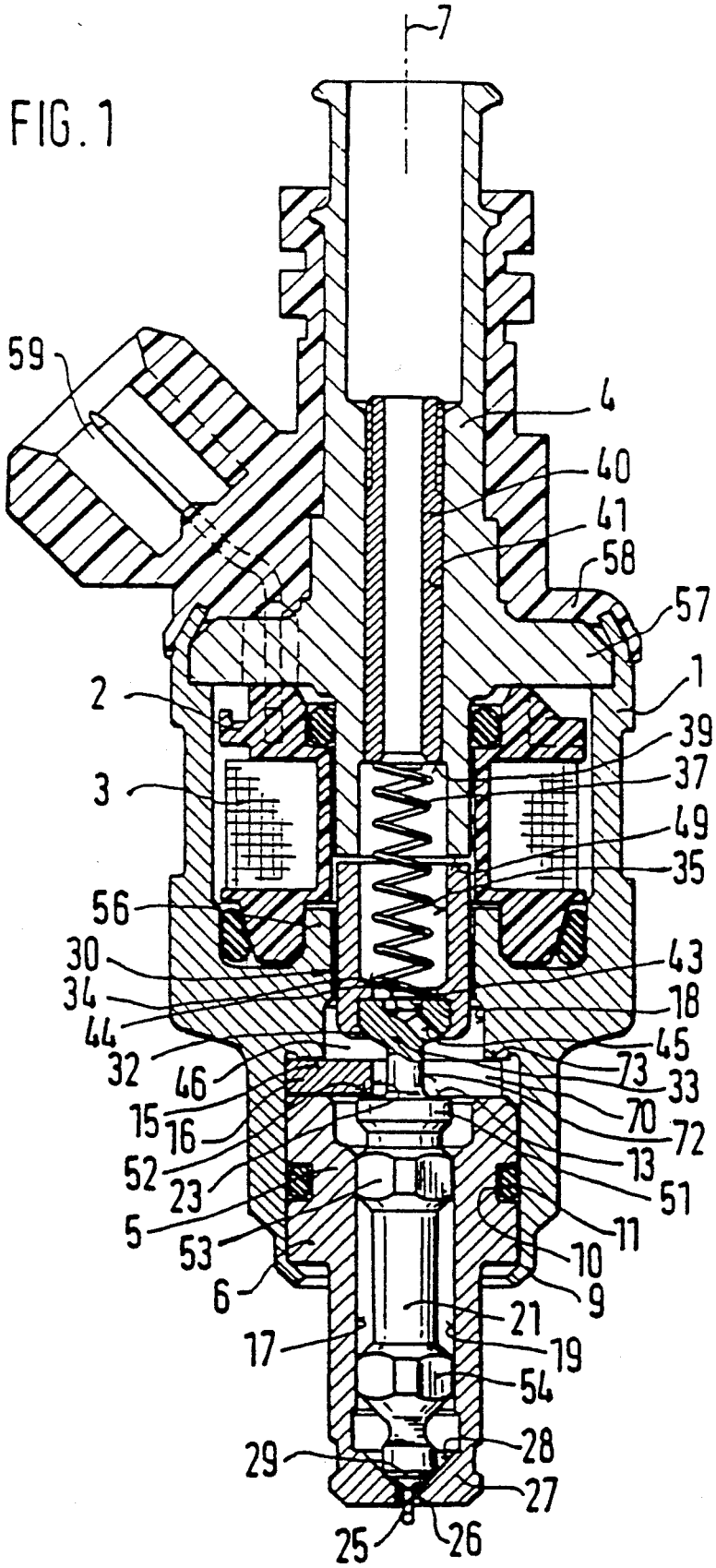

The invention is directed to an electromagnetically actuable fuel injection valve. German Patent 2,905,099 has already disclosed an electromagnetically actuable fuel injection valve in which a stop plate is arranged between a stop shoulder of the valve needle and an inner shoulder of the valve casing, the said stop plate limiting the stroke of the valve needle. Between its through opening and its circumference, the stop plate has an assembly slot, the clear width of which is larger than the diameter of the valve needle in the corresponding region. During assembly of the fuel injection valve, large axial forces act on the valve casing, the stop plate and the nozzle body due to the flanging of that end of the valve casing which faces the valve seat around the nozzle body guiding the valve needle. Due to the impressing of the stop plate, this leads to plastic deformations of the metallically soft valve casing, which is designed to be of a ferromagnetic material. The high edge pressure at the assembly slot can give rise to non-uniform and particularly pronounced deformations of the inner shoulder of the valve casing. Dimensional and position changes of the stop plate, the valve casing and the valve needle resulting from this have an effect, for example in the form of altered ejection quantities, on the operating behavior of the fuel injection valve.

ADVANTAGES OF THE INVENTION

In contrast, the fuel injection valve according to the invention, has the advantage of improved assembly, a more exact installation position of the stop plate and of the nozzle body and hence a higher stability under conditions of continuous running. The recesses additionally formed in the stop plate lead to a uniform and reduced impressing of the stop plate in the region of the assembly slot into the inner shoulder of the valve casing and hence to particularly low dimensional and position changes of the stop plate, the valve casing, the nozzle body and the valve needle.

Advantageous further developments and improvements of the fuel injection valve given are possible by means of the measures presented herein.

It is particularly advantageous if the width of the recesses corresponds approximately to the width of the assembly slot, guaranteeing particularly uniform and slight impressing of the stop plate in the region of the assembly slot into the inner shoulder of the valve casing.

It is advantageous if the recesses are designed as grooves and the grooves extend radially from the through opening towards the circumference of the stop plate. This makes possible a completely symmetrical design of an upper stop-plate stop face resting against the inner shoulder of the valve casing and hence particularly uniform and slight impressing of the stop plate in the region of the assembly slot into the inner shoulder of the valve casing.

However, it is also advantageous if the recesses are designed as pockets which are open towards the circumference of the stop plate and can pass through the stop plate, with the result that the recesses can be produced in a simple manner and nevertheless guarantee a reduced and uniform deformation of the inner shoulder of the valve casing by the stop plate in the region of the assembly slot.

It is advantageous here if the pockets are of circular design, allowing them to be produced in a particularly simple manner by means of a milling cutter or drill.

DRAWING

Figure 2:
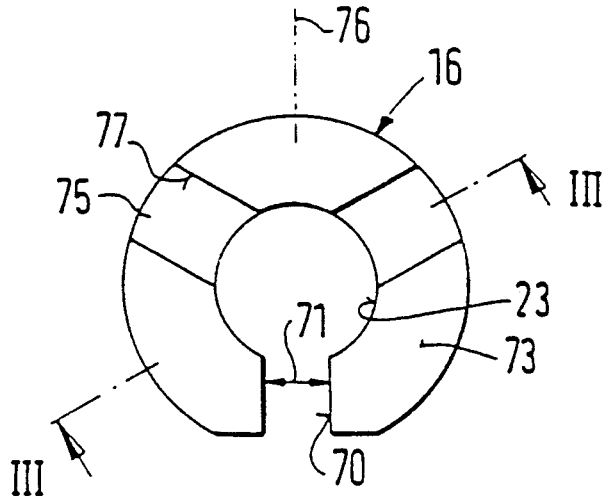
Figure 3:
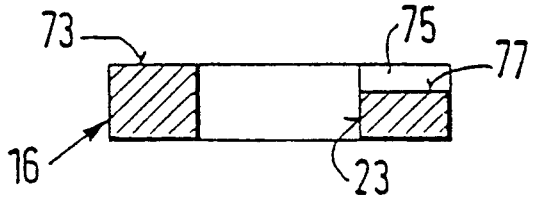
Figure 4:
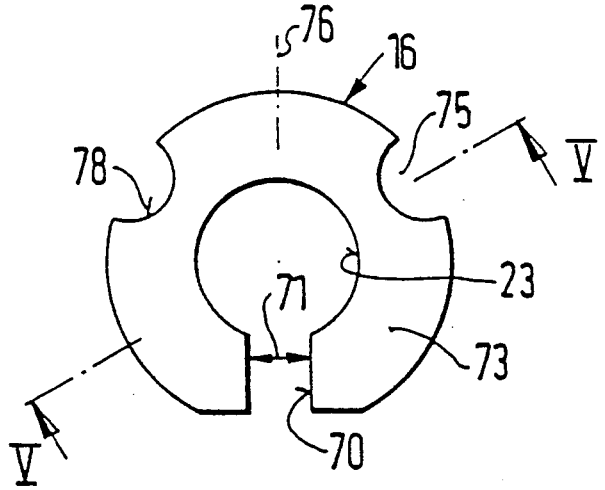
Figure 5:
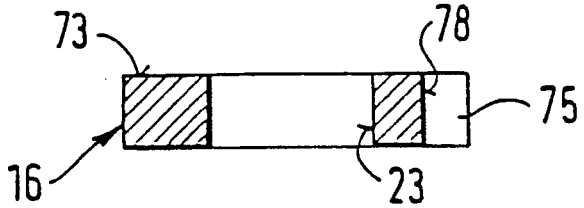

Illustrative embodiments of the invention are depicted in simplified form in the drawing and explained in greater detail in the description. In the drawing, FIG. 1 shows a fuel injection valve, FIG. 2 shows a first illustrative embodiment of a stop plate designed in accordance with the invention, FIG. 3 shows a section along the line III—III in FIG. 2, FIG. 4 shows a second illustrative embodiment of a stop plate designed in accordance with the invention and FIG. 5 shows a section along the line V—V in FIG. 4.

DESCRIPTION OF THE ILLUSTRATIVE EMBODIMENTS

The electromagnetically actuable fuel injection valve for fuel injection systems of internal combustion engines, which is depicted by way of example in FIG. 1, has a tubular valve casing 1, in which a magnet coil 3 is arranged on a coil former 2. The coil former 2 partially surrounds a core 4 of step-shaped configuration which extends concentrically to a longitudinal valve axis 7, is of tubular design and via which the fuel is supplied. At its end facing away from the magnet coil 3, the valve casing 1 surrounds a retention flange 5 of a nozzle body 6 with a flanged rim 9 having a reduced wall thickness. The connection of the valve casing 1 to the nozzle body 6 is achieved by flanging the flanged rim 9 around the retention flange 5 of the nozzle body 6. To achieve a fluid-tight seal between the valve casing 1 and the nozzle body 6, an annular groove 10, in which a sealing ring 11 is arranged, is formed on the circumference of the retention flange 5.

Clamped between an end face 13 of the retention flange 5, which end face faces the magnet coil 3, and an inner shoulder 15 of the valve casing 1, which inner shoulder lies opposite the end face 13 in the axial direction, is a substantially cylindrical stop plate 16 which serves to limit the movement of a valve needle 21 arranged in a stepped longitudinal bore 17 of the nozzle body 6, the said bore having a guiding region 19, and projecting into a stepped longitudinal bore 18 of the valve casing 1 and which, for the purpose of accurate setting of the stroke of the valve needle 21, has a particular thickness. The valve needle 21 passes through a through opening 23 of the stop plate 16 with radial clearance and protrudes with a pintle 25 from an injection orifice 26 of the nozzle body 6. Formed on an inner shoulder 27 of the nozzle body 6, at the end facing away from the retention flange 5, is a frustoconical seat 28 which interacts with an outer conical face 29 of the valve needle., 21. At its other end, the valve needle 21 is connected to a tubular armature 30, the armature 30 engaging, with its deformation region 32 facing the seat 28, around a retention end 33 of the valve needle 21. A return spring 37 rests on a flat end face 34 of the retention end 33, the said end face facing the core 4, and is guided radially by a stepped inner bore 35 of the armature 30. With its other end, the return spring 37 rests against a downstream end face 39 of a tubular adjusting sleeve 40, which is pressed into a stepped through bore 41 of the core 4. The depth to which the adjusting sleeve 40 is pressed into the core 4 determines the spring force with which the return spring 37 acts on the armature and the valve needle 21 and which counteracts the opening stroke of the valve needle 21.

Formed in that end face 34 of the retention end 33 which faces the core 4 is a coaxial blind bore 43 of smaller diameter than the inside diameter of the return spring 37, at t e bottom 44 of which there is at least one throughflow opening 45, extending for example obliquely, which establishes a connection to an interior space 46 which is surrounded by the valve casing 1 and the nozzle body 6 and accommodates the valve needle 21, allowing the fuel to pass from the through bore 41 of the core 4 to the seat 28 of the nozzle body 6.

The length of the valve needle 21 and of the armature 30, starting from the outer conical face 29, is dimensioned in such a way that, when the magnet coil 3 is not excited, the armature 30 leaves free a working gap relative to an end face 49 of the core 4, the said end face facing the armature 30. The valve needle 21 has a stop shoulder 51, the stop front face 52 of which interacts with the stop plate 16 and limits the stroke of the valve needle 21 when the magnet coil 3 is excited and hence when the fuel injection valve is opened. This prevents a direct contact occurring between the armature 30 and the core 4 since there is always a working gap between the two even when the magnet coil 3 is excited.

The valve needle 21 has two guiding portions 53 and 54, which provide the valve needle 21 with guidance in the guiding portion 19 of the longitudinal bore 17, leaves free an axial passage for the fuel and, for example, are designed as substantially squares.

The magnetic flux is conducted to the armature 30 by the shell of the valve casing 1 via a magnetic-flux conductor step 56 which directly surrounds the armature 30 by the shell of the valve casing 1 via the core 4 serving as fuel inlet connection, via a conductor flange 57 of the core 4.

At least part of the core 4 and of the valve casing 1 are surrounded in the axial direction by a plastic sheath 58. An electrical connector 59, via which the electrical contacting of the magnet coil 3 and hence its excitation is effected, is molded onto the plastic sheath 58.

A first illustrative embodiment, according to the invention, of the stop plate 16 is shown by FIG. 2. Provided between the through opening 23 and the circumference of the stop plate 16 is an assembly slot 70, the clear width 71 of which is larger than the diameter of the valve needle 21 in the corresponding region 72 of the valve needle 21, between its retention end 33 and its stop shoulder 51.

Apart from this assembly slot 70 there are, for example, two recesses 75 formed in an upper stop face 73 of the stop plate 16, the said stop face resting against the inner shoulder 15 of the valve casing 1, these recesses lying symmetrically to a center line 76, running through the longitudinal valve axis 7, of the assembly slot 70 and in a half of the stop plate 16 in which the assembly slot 70 is not formed and which is bounded by a plane which extends perpendicularly to the center line 76 of the assembly slot 70 and through the longitudinal valve axis 7.

As can also be seen from FIG. 3, which shows a section along the line III—III of the first illustrative embodiment depicted in FIG. 2, the two recesses 75 have the shape of grooves 77 which extend radially from the through opening 23 towards the circumference of the stop plate 16. The symmetrical design, achieved by means of the recesses 75, of the upper stop face 73 of the stop plate 16, which leads, both during assembly and in operation, to a uniform and slight impressing of the stop plate 16 into the inner shoulder 15 of the valve casing 1 and hence to particularly small dimensional and position changes of the stop plate 16, the valve casing 1, the nozzle body 6 and the valve needle 21 in the region of the assembly slot 70 despite the high forces acting in the axial direction, is additionally improved, as illustrated by way of example in the first illustrative embodiment, if the width of the recesses 75 or grooves 77 corresponds to the clear width 71 of the assembly slot 70.

FIG. 4 shows a second illustrative embodiment according to the invention, in which identical parts and parts with the same effect are indicated by the same reference numerals as in FIGS. 1 to 3. Between its through opening 23 and its circumference, the stop plate 16 has an assembly slot 70, the clear width 71 of which is larger than the diameter of the valve needle 21 in the corresponding region 72 of the valve needle 21.

A number of recesses 75, for example two, are formed symmetrically to the center line 76, running through the longitudinal valve axis 7 of the assembly slot 70 and in that half of the stop plate 16 which does not have the assembly slot 70 and which is bounded by the plane which extends perpendicularly to the center line 76 of the assembly slot 70 and through the longitudinal valve axis 7.

The recesses 75 are formed on the circumference of the stop plate 16 as pockets 78 which are open towards the circumference, have, for example, the shape of a semicircle and, as can also be seen from FIG. 5, which shows a section along the line V—V in FIG. 4, pass through the stop plate 16. Despite the high forces acting in the axial direction during assembly and in operation, the virtually symmetrically formed upper stop face 73 of the stop plate 16, which interacts with the inner shoulder 15 of the valve casing 1, leads to a uniform and only slight impressing of the stop plate 16 in the region of the assembly slot 70 into the inner shoulder 15 of the valve casing 1, with the result that only small dimensional and position changes of the stop plate 16, the valve casing 1, the nozzle body 6 and the valve needle 21 occur.

The small dimensional and position changes when the stop plate 16 according to the invention is used, and hence the particularly exact installation position of the stop plate 16 and of the nozzle body 6 make possible a high stability if the fuel injection valve under conditions of continuous running.

The foregoing relates to a preferred exemplary embodiment of the invention, it being understood that other variants and embodiments thereof are possible within the spirit and scope of the invention, the latter being defined by the appended claims.

We claim:

1. An electromagnetically actuable fuel injection valve for fuel injection systems of internal combustion engines, with a valve casing composed of a ferromagnetic material, a magnet coil, a core, an armature which interacts with the core and is firmly connected to a valve needle having a stop shoulder, a stop plate which is clamped in between an inner shoulder of the valve casing and a nozzle body which guides the valve needle and has a central through opening accommodating a cylindrical region of the valve needle and extending concentrically to a longitudinal valve axis and has an assembly slot which leads radially from the through opening to a circumference of the stop plate, at least two recesses (75) being formed in an upper stop face (73) of the stop plate (16) and extending to the circumference, said upper stop face resting against the inner shoulder (15) of the valve casing (1), said at least two recesses (75) being symmetrically arranged about a center line (76), which extends through the longitudinal valve axis (7), of the assembly slot (70) and in a half of the stop plate (16) opposite that in which the assembly slot (70) is formed and which is bounded by a plane extending perpendicularly to the center line (76) of the assembly slot (70) and through the longitudinal valve axis (7).

2. A fuel injection valve according to claim 1, in that the width of each of the recesses (75) corresponds approximately to the width of the assembly slot (70).

3. A fuel injection valve according to claim 1, in that the recesses (75) are designed as grooves (77).

4. A fuel injection valve according to claim 2, in that the recesses (75) are designed as grooves (77).

5. A fuel injection valve according to claim 3, in that the grooves (77) extend radially from the through opening (23) towards the circumference of the stop plate (16).

6. A fuel injection valve according to claim 4, in that the the grooves (77) extend radially from the through opening (23) towards the circumference of the stop plate (16).

7. A fuel injection valve according to claim 1, in that the recesses (75) are designed as pockets (78) which are open toward the circumference of the stop plate (16).

8. A fuel injection valve according to claim 2, in that the recesses (75) are designed as pockets (78) which are open toward the circumference of the stop plate (16).

9. A fuel injection valve according to claim 7, in that the pockets (78) pass through the stop plate (16).

10. A fuel injection valve according to claim 8, in that the pockets (78) pass through the stop plate (16).

11. A fuel injection valve according to claim 7, in that the pockets (78) are of circular design.

12. A fuel injection valve according to claim 8, in that the pockets (78) are of circular design.

13. A fuel injection valve according to claim 9, in that the pockets (78) are of circular design.

14. A fuel injection valve according to claim 10, in that the pockets (78) are of circular design.

15. A stop plate for an electromagnetically operated injection valve which limits an opening movement of an injection valve needle which comprises a substantially cylindrical body having a cylindrical axial opening (23), a radial slot (70) that extends from said cylindrical axial opening, said stop plate including radially extending recesses (75) formed by grooves in an upper face of said stop plate which extend to the outer circumference thereof and which are symmetrical to a center line of said stop plate and equally spaced relative to said radial slot (70).

16. A stop plate as set forth in claim 15 wherein said recesses (75) are semicircular in shape and formed in a circumferential face of said stop plate.

* * * * *